US007343939B1

(12) United States Patent
Sheriff

(10) Patent No.: US 7,343,939 B1
(45) Date of Patent: Mar. 18, 2008

(54) METHOD OF FORMING A LOOP IN A WIRE

(75) Inventor: Timothy W. Sheriff, Duluth, MN (US)

(73) Assignee: Swanstrom Tools USA Inc., Superior, WI (US)

( * ) Notice: Subject to any disclaimer, the term of this patent is extended or adjusted under 35 U.S.C. 154(b) by 0 days.

(21) Appl. No.: 11/408,229

(22) Filed: Apr. 20, 2006

Related U.S. Application Data

(63) Continuation-in-part of application No. 10/664,108, filed on Sep. 17, 2003, now Pat. No. 7,032,627.

(51) Int. Cl.
*B21F 3/00* (2006.01)

(52) U.S. Cl. ..... 140/102.5; 140/93 A; 72/409.01

(58) Field of Classification Search ..... 140/93 A, 140/102, 102.5, 104; 72/409.01
See application file for complete search history.

(56) References Cited

U.S. PATENT DOCUMENTS

| | | | | | |
|---|---|---|---|---|---|
| 649,955 | A | * | 5/1900 | Ronk | 7/134 |
| 1,337,616 | A | * | 4/1920 | Olhovsky | 140/102.5 |
| 2,824,583 | A | * | 2/1958 | Knoester | 140/104 |
| 2,854,874 | A | * | 10/1958 | Decker | 29/243.5 |
| 2,857,792 | A | | 10/1958 | McNish | |
| 3,174,517 | A | | 3/1965 | Wilson | |
| 3,221,779 | A | * | 12/1965 | Noel | 140/104 |
| 3,360,018 | A | | 12/1967 | Lindsay | |
| 3,847,189 | A | | 11/1974 | Guzda | |
| 3,861,430 | A | | 1/1975 | Story | |
| 4,043,364 | A | | 8/1977 | Rose | |
| 4,221,118 | A | | 9/1980 | Chicckine | |
| 4,423,757 | A | * | 1/1984 | Broberg, Jr. | 140/123 |
| 4,637,084 | A | | 1/1987 | Wood | |
| 5,277,231 | A | | 1/1994 | Dostalek | |
| 5,520,227 | A | | 5/1996 | Kelley | |
| 5,632,086 | A | | 5/1997 | Helwig | |
| 5,878,788 | A | | 3/1999 | Gurry | |
| 6,108,878 | A | | 8/2000 | Adell | |

OTHER PUBLICATIONS

"How to Make Basic Wire Earrings", eHow.com, http://www.ehow.com/how_18139_make-basic-wire.html, 1999-2006, 3 pages.
Easy Ear Wire Jig product description, Contenti, http://www.contenti.com/products/beading-supplies/540-213.html, 1 page.
EZ Earring product description, http://www.bosbeads.com/EZ_Earring.html, 4 pages.

* cited by examiner

*Primary Examiner*—Derris H. Banks
*Assistant Examiner*—Debra M Wolfe
(74) *Attorney, Agent, or Firm*—Faegre & Benson LLP

(57) ABSTRACT

A method of wire forming using a pliers having opposed faces on jaws, each with a relief between the face and a pivot point of the pliers, the reliefs forming a recess, and a link movably secured to the pivot point and carrying a post extending into the recess, the method including forming a loop in a U-shaped wire received in the recess around the post by closing the jaws until the faces compress the U-shape into a loop around the post, and in an alternative embodiment, an elongated link retained to the pliers with a spring holds the post in a desired position before engagement between the wire and post, and wherein the link is extendable to position the post beyond the jaws to allow further formation of the wire received around the post.

10 Claims, 22 Drawing Sheets

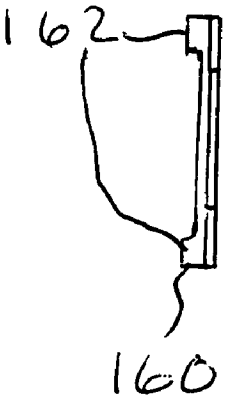
Fig. 24
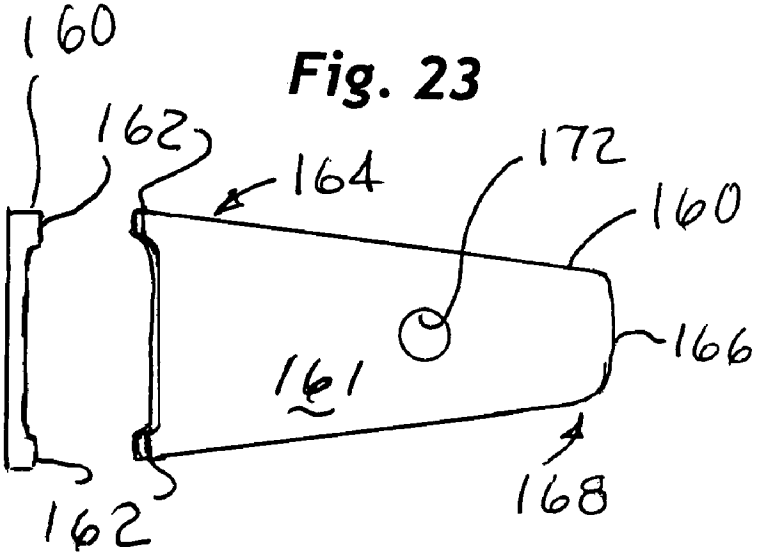
Fig. 23
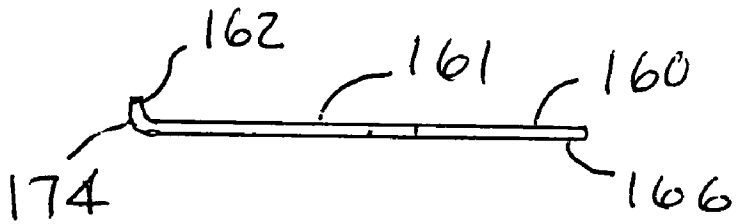
Fig. 25
Fig. 22

METHOD OF FORMING A LOOP IN A WIRE

CROSS-REFERENCE TO RELATED APPLICATION

This application is a Continuation-In-Part of application Ser. No. 10/664,108 filed Sep. 17, 2003, now U.S. Pat. No. 7,032,627, the entire contents of which are hereby incorporated by reference.

BACKGROUND OF THE INVENTION

The present invention relates to the field of hand tools for forming wire and the like, more particularly, to a method of using a pliers for forming wire into loops and similar shapes.

In the past, wire loops have been formed using conventional longnose pliers, resulting in imperfect loops. Round nose pliers have permitted formation of more circular loops, but did not assure that repeated use would result in identical sized loops, because of the tapered jaws of the pliers.

Other specialty pliers are known for forming wires into loops, commonly known as wire wrapping pliers, which have one jaw formed in a series of stepped diameter cylinders, and the other jaw being flat or concave where it faces the cylindrical jaw. Such wire wrapping pliers were not convenient to forming tight loops because the wire was gripped between the jaws at a location which was typically 180 degrees away from the closure of the loop. Forming the loop adjacent the contact between the jaws of such pliers exposes the wire to the edge of the flat or concave jaw, reintroducing the possibility of undesired deformation of the wire resulting from contact with such edge.

The present invention overcomes the shortcomings of the prior art by using a pliers-type wire forming tool in an easy and convenient method to form consistently-sized wire loops, with or without a coil adjacent the loop.

BRIEF SUMMARY OF THE INVENTION

In one aspect, the present invention includes a method for forming a loop in a wire forming a U-shape in a wire, placing the U-shape between a pair of jaws in a pliers of the type having opposing faces on respective distal ends of a pair of jaws, with each jaw having a relief between the face and a pivot point of the pliers, the reliefs forming a recess, such that the U-shape extends around a post located in the recess, closing the jaws against the wire such that the faces compress the U-shape into a loop surrounding the post; and removing the wire loop from the pliers.

The method may further include that aspect wherein the post is carried by a link loosely secured to the pivot point of the pliers.

The method may further include that aspect wherein the opposing faces are each flat.

The method may further include an additional step before the step of closing the jaws, the additional step including adjusting a stop to limit the distance the faces can approach each other.

The method may further include an additional aspect wherein the step of forming a U-shape in the wire further includes using a through hole in the pliers to form the U-shape in the wire.

The method may further include an additional step between the steps of closing the jaws and removing the wire loop from the pliers, the additional step including deforming at least one of two portions of the wire extending distally of the faces.

The method may further include an additional aspect wherein the step of deforming at least one of two portions of the wire further includes deforming at least one portion of the wire around the other portion of the wire to form a coil adjacent the loop.

The present invention may also be seen to include an improvement to a tool with a first member and a second member, each having a jaw and a handle and a mediate region between the jaw and handle; and a connecting means for securing the first and second members together at the mediate regions thereof and for permitting pivoting movement between the first and second members while locating the jaws on the same side of the connecting means such that the jaws are opposed to each other and free to move towards and away from each other; and a link attached to the mediate regions of the first and second members, and extending on the same side of the connecting means as the jaws, the link having a post projecting from the link and extending intermediate the jaws for forming wire around the post, the improvement in combination therewith including a resilient biasing means urging the link against the mediate region of one of the first and second members such that the link is manually positionable to a desired position with respect to the jaws of the tool and the resilient biasing means retains the link in the desired position until a wire is received on the link.

In another aspect the present invention includes a method of retaining a position of a link having a loop-forming post thereon with respect to a pair of jaws in a pliers to assist in forming a loop in wire by performing the steps of manually positioning the link before or after forming a U-shape in a wire; and thereafter placing the U-shape between the pair of jaws in a pliers of the type having opposing faces on respective distal ends of a pair of jaws, with each jaw having a relief between the face and a pivot point of the pliers, the reliefs forming a recess, such that the U-shape extends around a post located in the recess; closing the jaws against the wire such that the faces compress the U-shape into a loop surrounding the post; and removing the wire loop from the pliers.

BRIEF DESCRIPTION OF THE SEVERAL VIEWS OF THE DRAWINGS

FIG. 22 is a first end view of a spring useful in the alternative embodiment of FIG. 18.

FIG. 23 is a plan view of the spring of FIG. 22.

FIG. 24 is a second end view of the spring of FIG. 22.

FIG. 25 is a side elevation view of the spring of FIG. 22.

DETAILED DESCRIPTION OF THE INVENTION

Figure 1:
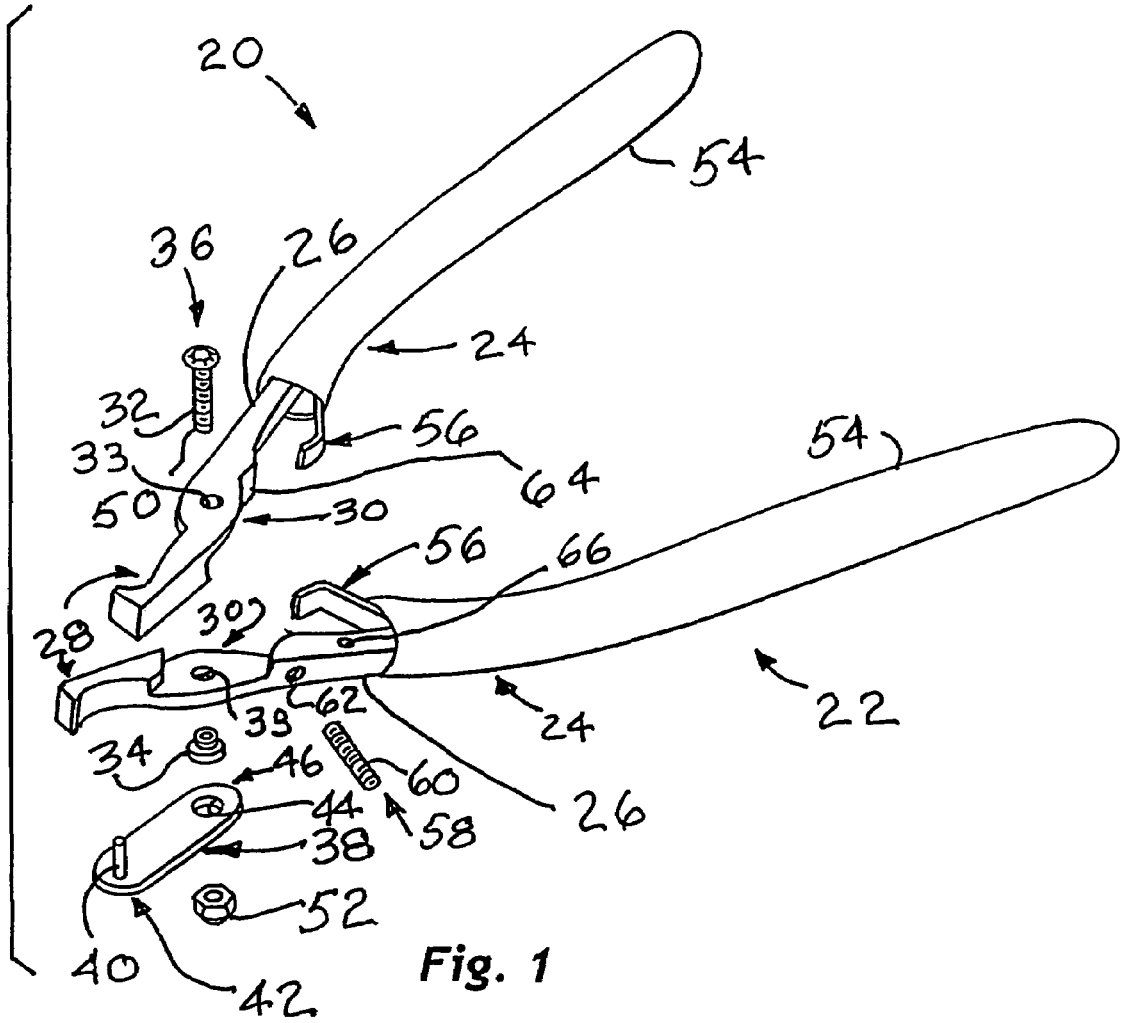
FIG. 1 is an exploded view from above of the parts of the pliers of the present invention.
Figure 2:
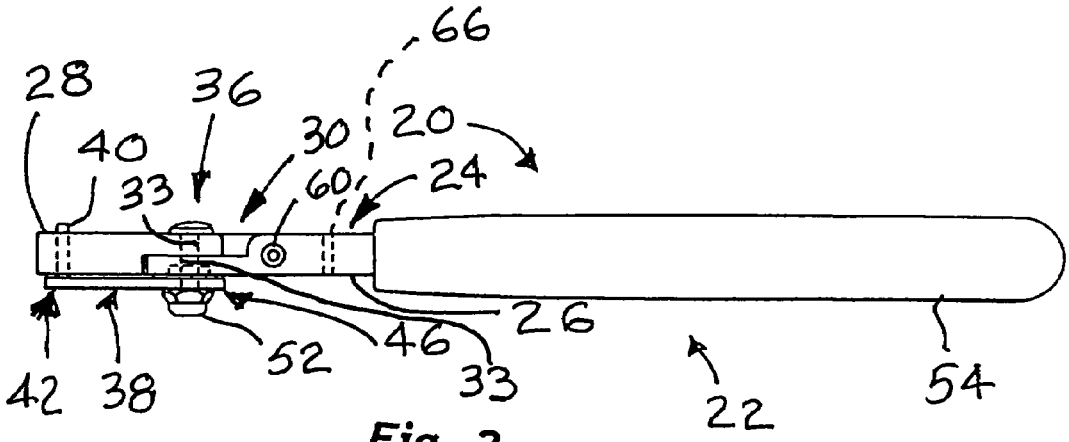
FIG. 2 is an elevational side view of an assembled pliers of the present invention.
Figure 3:
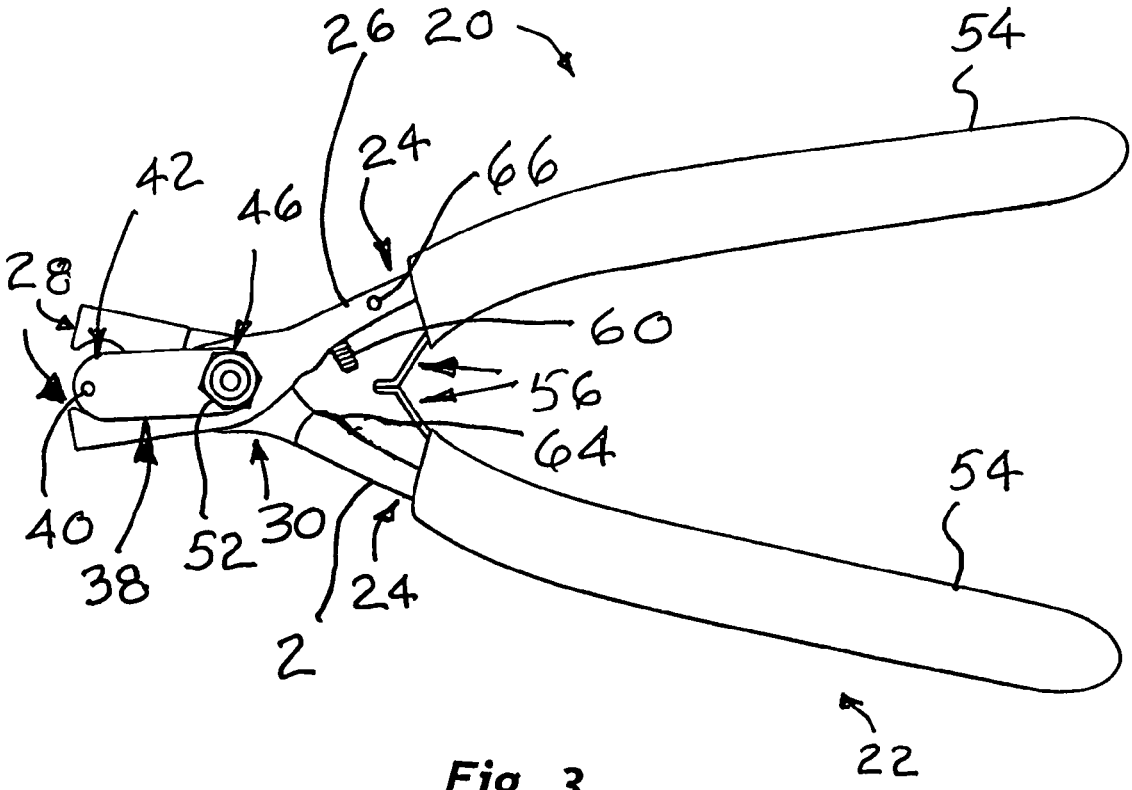
FIG. 3 is bottom plan view of the pliers of FIG. 2.

Referring now to the Figures, and most particularly, to FIGS. 1, 2 and 3, a hand tool 20, generally in the form of a pair of pliers 22 may be seen. Pliers 22 are preferably formed with two nearly identical members 24, each of which have a handle 26 and a jaw 28 connected by a mediate portion 30.

The pliers 22 have members 24 joined at the mediate portions or regions 30 for pivoting movement between members 24. One or both of a screw 32 and rivet 34 form a pivot or connecting means 36 for securing members 24 together for pivoting movement therebetween. Alternatively, other forms of pivoting securement may be used while still staying within the scope of the present invention. The connecting means 36 secures members 24 (which may be referred to as "first and second members") together at the mediate portions or regions 30 thereof, while at the same time permitting pivoting movement between the first and second members while locating the jaws 28 on the same (distal) side of the connecting means 36 such that the jaws 28 are opposed to each other and free to move towards and away from each other. The connecting means 36 is thus understood to include the screw 32 received in one of the first and second members, and (preferably) further includes the threaded rivet received in the other of the first and second members with the screw 32 extending through a pair of aligned apertures 33 in the first and second members 24.

Figure 17:
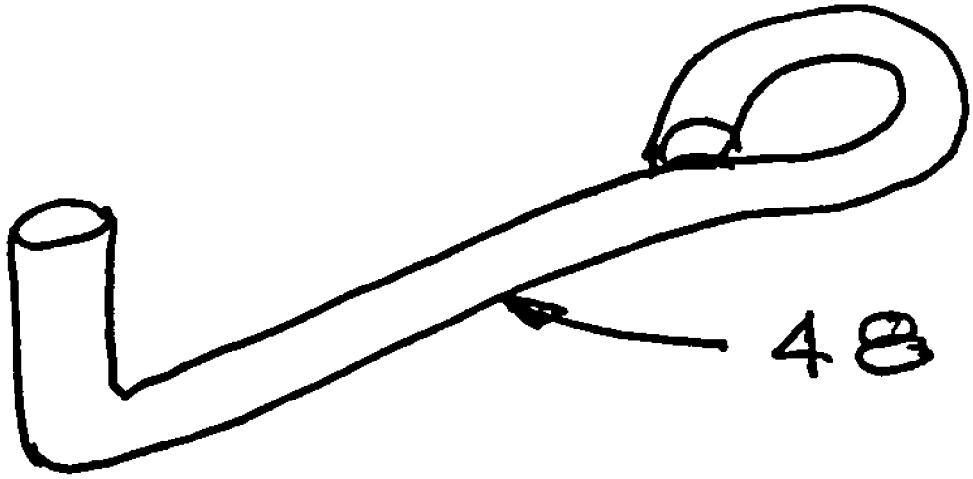
FIG. 17 is a still further alternative embodiment for the post and link of the present invention.

A link 38 is preferably also secured to the pliers 22 by the pivot 36, and preferably, the link 38 is free to move within a limited range of movement as will be described infra. Link 38 has a post 40 projecting from a first end 42 thereof, and an aperture 44 at a second end 46 thereof. Alternatively, the link and post may be formed of a single piece of wire 48, as shown in FIG. 17. The link 38 is attached to the mediate region 30 of at least one of the first and second members 24 and extends on the same (distal) side of the connecting means 36 as the jaws 28. The post 40 projecting from the link 38 extends intermediate the jaws 28 for forming wire around the post 40, in a manner to be described infra.

It is to be understood that the pivot 36 preferably has a projection, such as additional threads 50 extending laterally from the mediate region 30 beyond the rivet 34 by an amount sufficient to retain the link 38 using, for example, a threaded fastener such as a locking nut 52 received on threads 50 to loosely hold link 38 to the pliers 22.

Optionally, each handle 26 may have a resilient cover 54 and pliers 22 may have a pair of opening springs 56, although neither is necessary for the present invention. Pliers 22 preferably also has a stop 58 to limit the approach of the jaws 28 together. Stop 58 is preferably formed by an Allen screw 60 received in a threaded bore 62 in one member 24 and an anvil surface 64 on the other member 24. As may be seen most clearly in FIG. 8, stop 58 provides an adjustable limit for the distance between the jaws when the handles 26 are grasped, closing the pliers 22. Such a limit is desirable to avoid marking or deforming wire being formed in the pliers. The stop 58, preferably made up of Allen screw 60 and anvil surface 64, limits the amount of pivoting movement of the jaws 28 toward each other.

Figure 4:
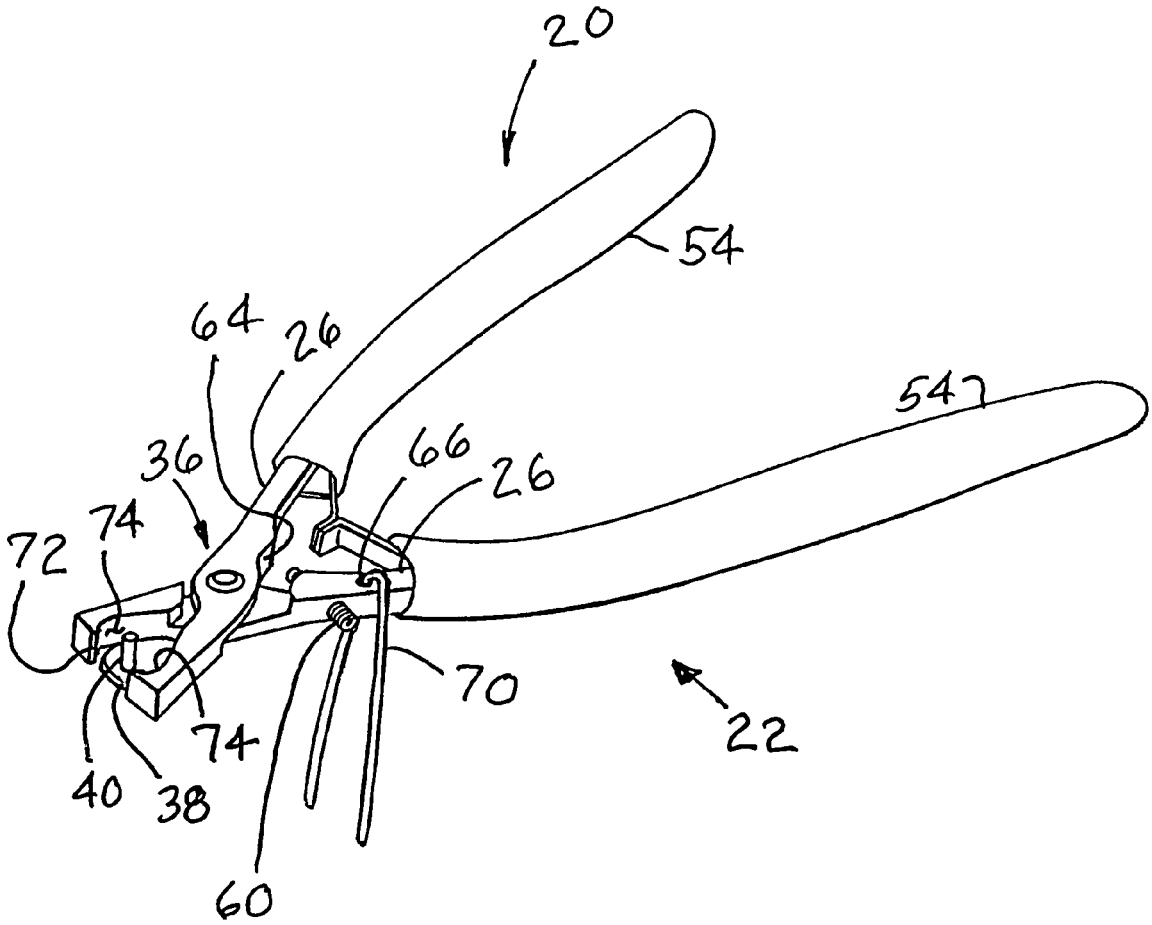
FIG. 4 is a perspective view of the pliers of FIG. 2, showing a wire bending feature forming a wire into a U-shape, preparatory to forming a loop in the wire.

Referring now also to FIG. 4, a smooth through-hole or bore 66 may be provided in one handle 26 to enable initial bending of a wire workpiece 70. The through hole 66 can be located in one (or even both) of the first and second members 24 for receiving the wire 70 to make a prebend therein.

Figure 5:
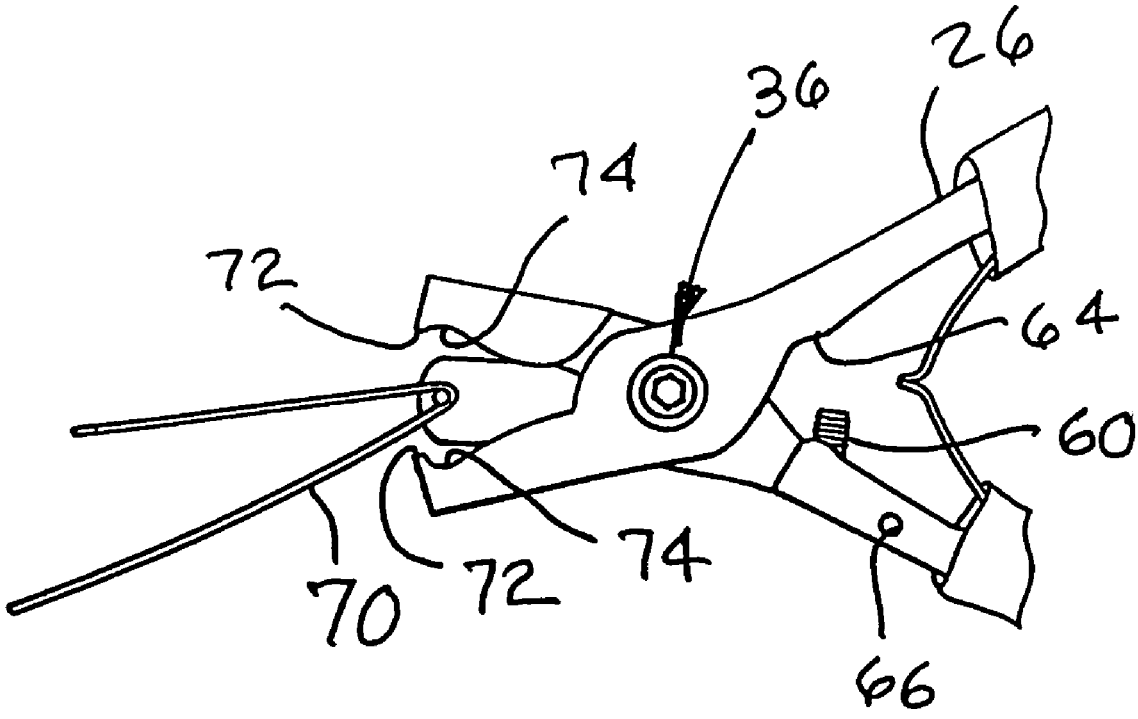
FIG. 5 is a fragmentary top plan view showing the U-shape of the wire received within the jaws and over a post in a recess of the jaws of the pliers of FIG. 2.
Figure 6:
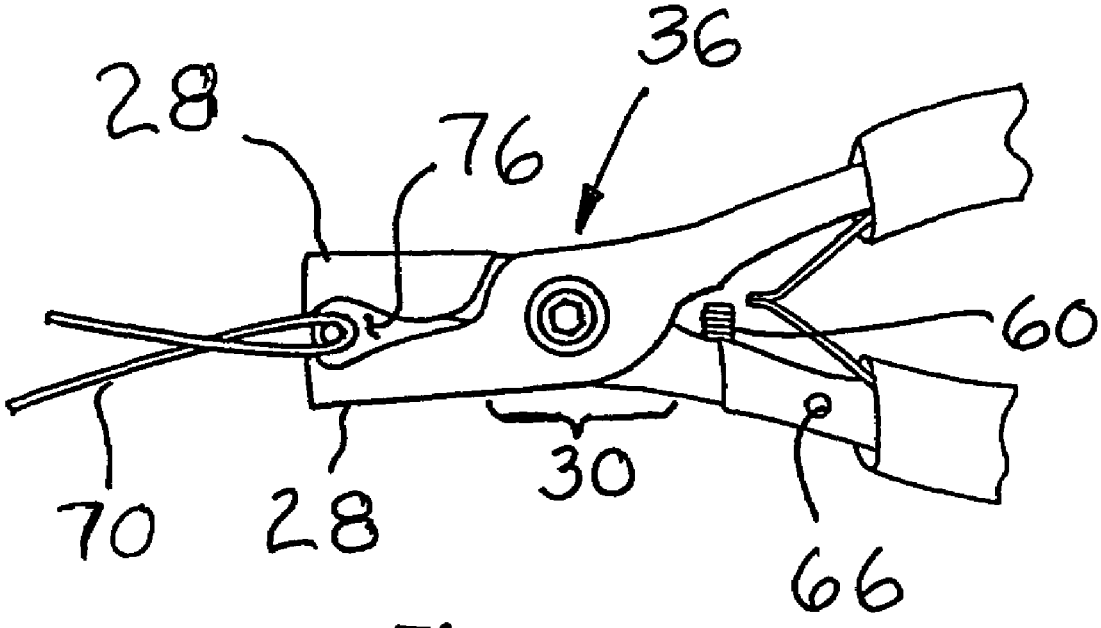
FIG. 6 is a view similar to that of FIG. 5, except with the jaws partially closed.

As may be seen most clearly in FIGS. 4 and 5, the jaws 28 each have a face 72 at a distal end thereof, and a relief 74 intermediate the face and the mediate region 30. When the first and second members are assembled with the faces 72 opposing each other, the reliefs 74 form a recess 76. The post 40 projects into recess 74, as may be seen clearly in FIG. 6, where the jaws 28 are partially closed toward each other. As shown in the Figures, faces 72 are flat; however, it is to be understood that one or both faces 72 may have other configurations while still remaining within the scope of the present invention. For example, and not by way of limitation, one or both faces may have a convex configuration with a smooth transition to the respective relief on that jaw to aid in making a smooth transition in the wire workpiece between the portion of the wire looped around the post and the portion(s) of the wire adjacent the faces of the jaws. It is to be understood, however, that the wire forming occurs primarily as a result of the post, and secondarily, as a result of the jaws. This is in contrast to specialty pliers in which the jaws alone are used to form a workpiece.

Figure 7:
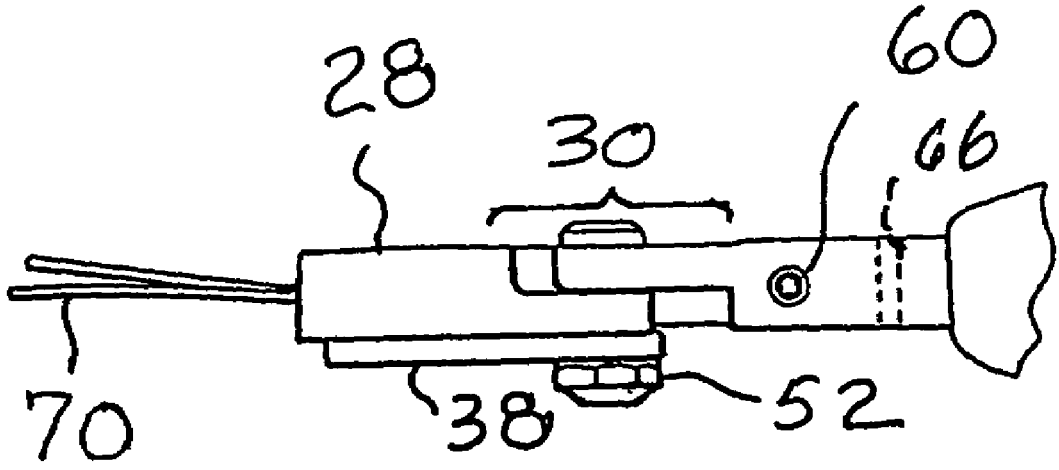
FIG. 7 is fragmentary elevational side view corresponding to that of FIG. 2, except showing a wire captured in the jaws of the pliers.
Figure 8:
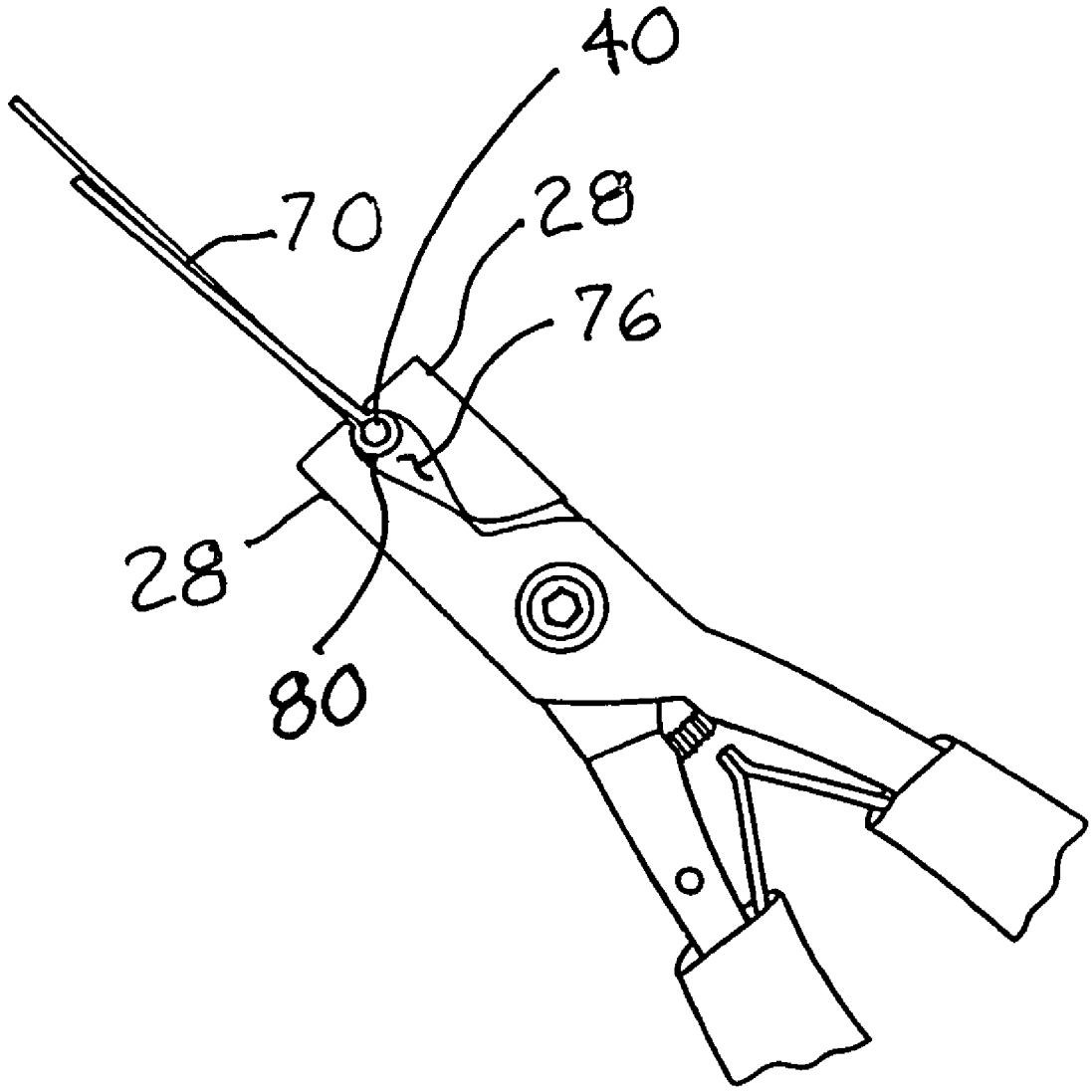
FIG. 8 is a view similar to that of FIG. 5, except with the jaws fully closed against the wire, forming the loop.
Figure 9:
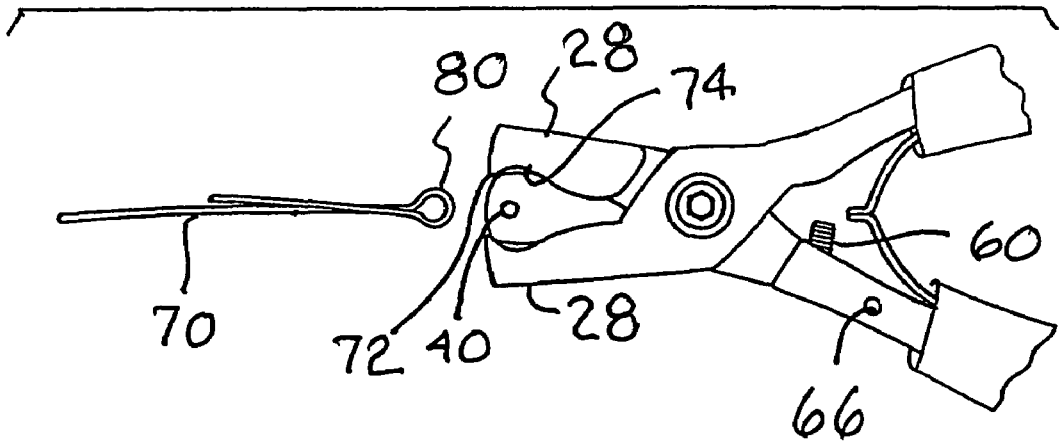
FIG. 9 is a fragmentary view similar to that of FIG. 4, except after the wire has been formed into a loop and removed from the pliers.
Figure 10:
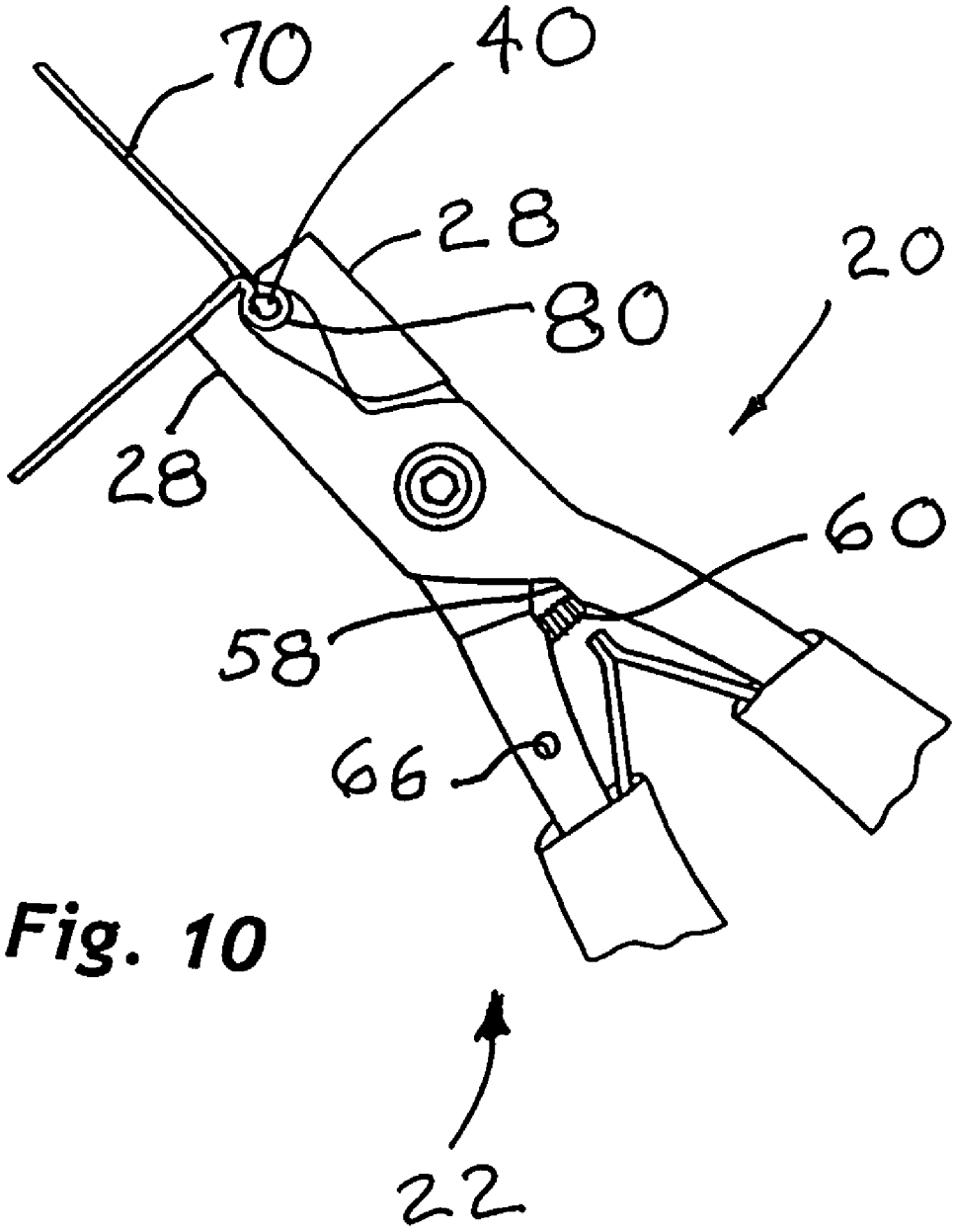
FIG. 10 is a view similar to that of FIG. 8, except with a portion of the wire deformed after formation of the loop.
Figure 11:
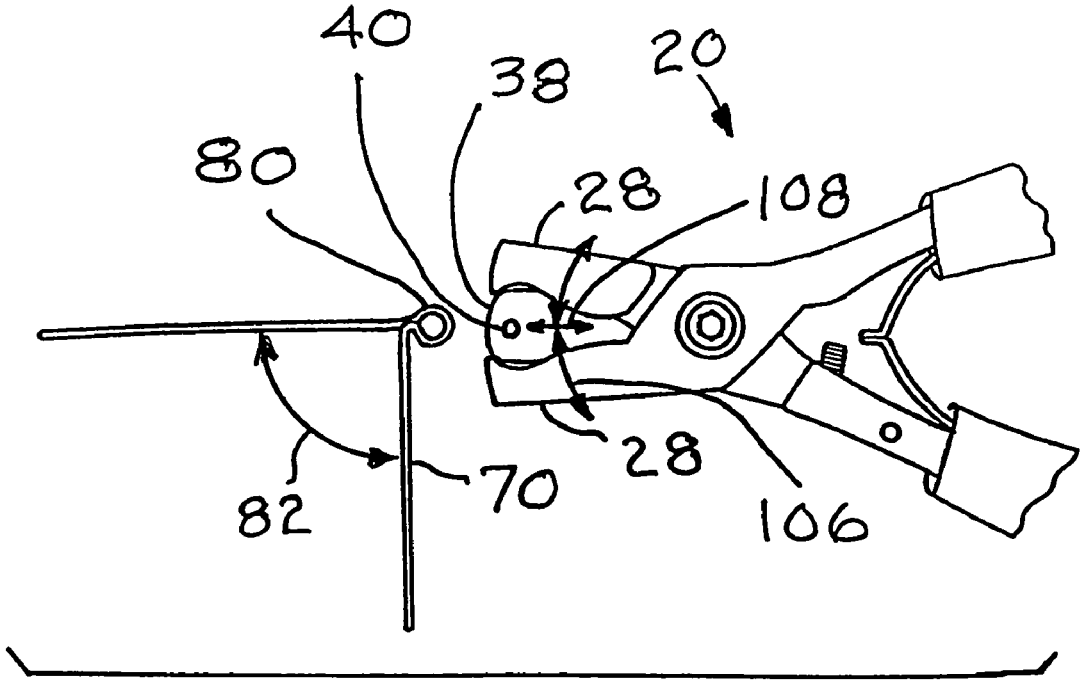
FIG. 11 is a view similar to that of FIG. 10, except with the wire removed from the pliers.
Figure 12:
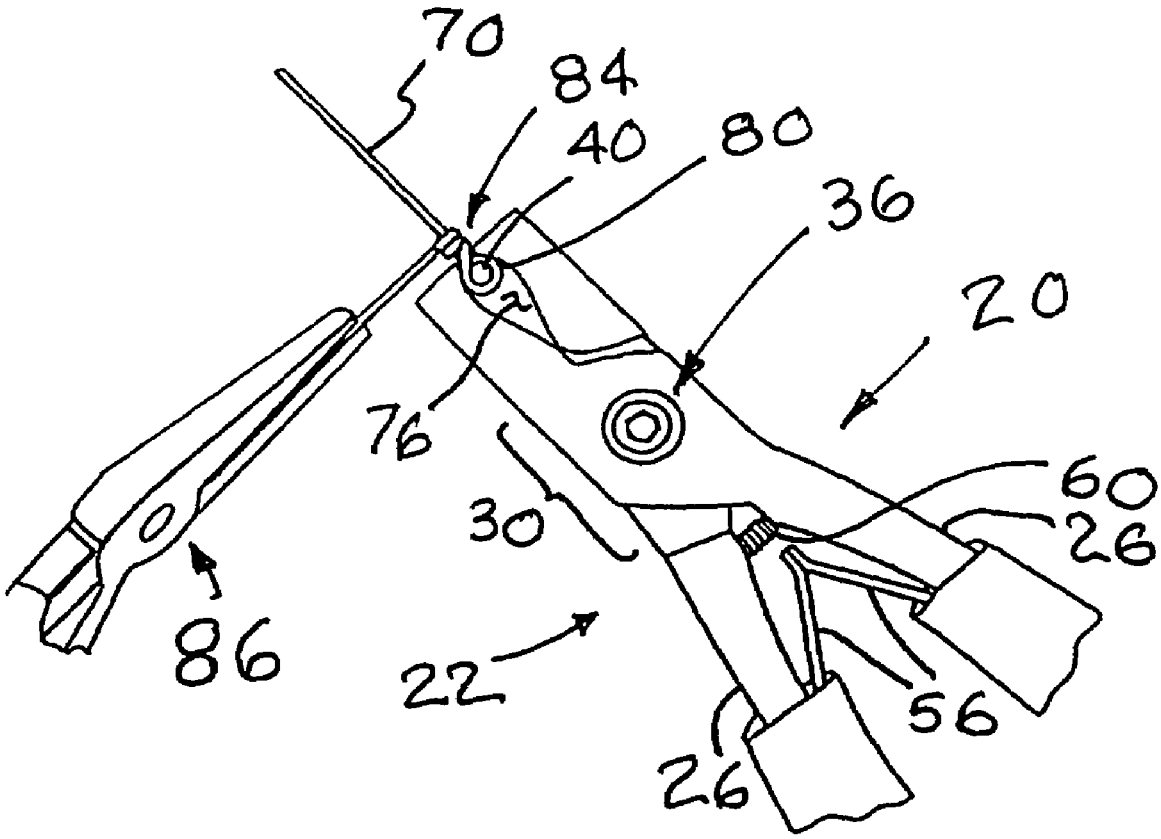
FIG. 12 is a view similar to that of FIG. 10, except showing formation of a coil adjacent the loop.
Figure 13:
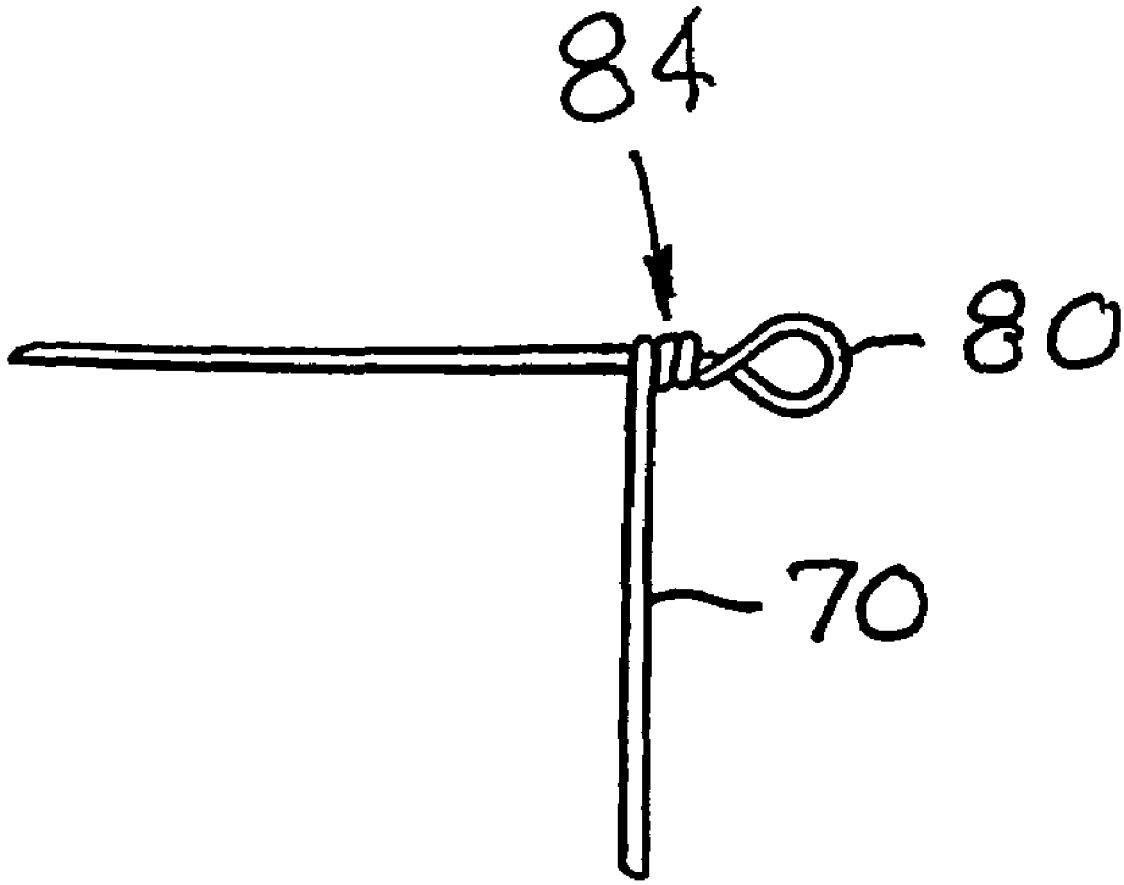
FIG. 13 is a view of the wire after formation of the loop and adjacent coil.

Referring now to FIG. 7, wire 70 is preferably held generally laterally centered within jaws 28. As the jaws 28 are closed against each other, as shown in FIG. 8, a loop 80 is formed in wire 70, which may also be seen separately in FIG. 9 after the jaws 28 are opened, and the wire is removed laterally from post 40 and out from recess 76. Alternatively, instead of removing the wire 70 from the tool 20 as shown in FIG. 9, the wire 70 may be held in tool 20 and further formed, as shown in FIGS. 10 and 12. FIG. 11 shows an intermediate stage in which the wire 70 is formed with the loop 80 and a right angle 82. FIG. 12 shows the process of forming the wire 70 to have a number of wraps 84 of one portion of the wire around another portion of the wire 70 to support the loop 80. A second tool, such as a longnose or duckbill pliers 86 may by used to assist in the formation of the wraps 84. Once the loop 80 and wraps 84 are formed in the wire 70, the wire workpiece will appear as it does in FIG. 13. At this time, the wire 70 may be further formed, or the tail 88 extending from the wraps 84 may be severed from the remainder of the wire workpiece, using conventional tools and processes.

Figure 14:
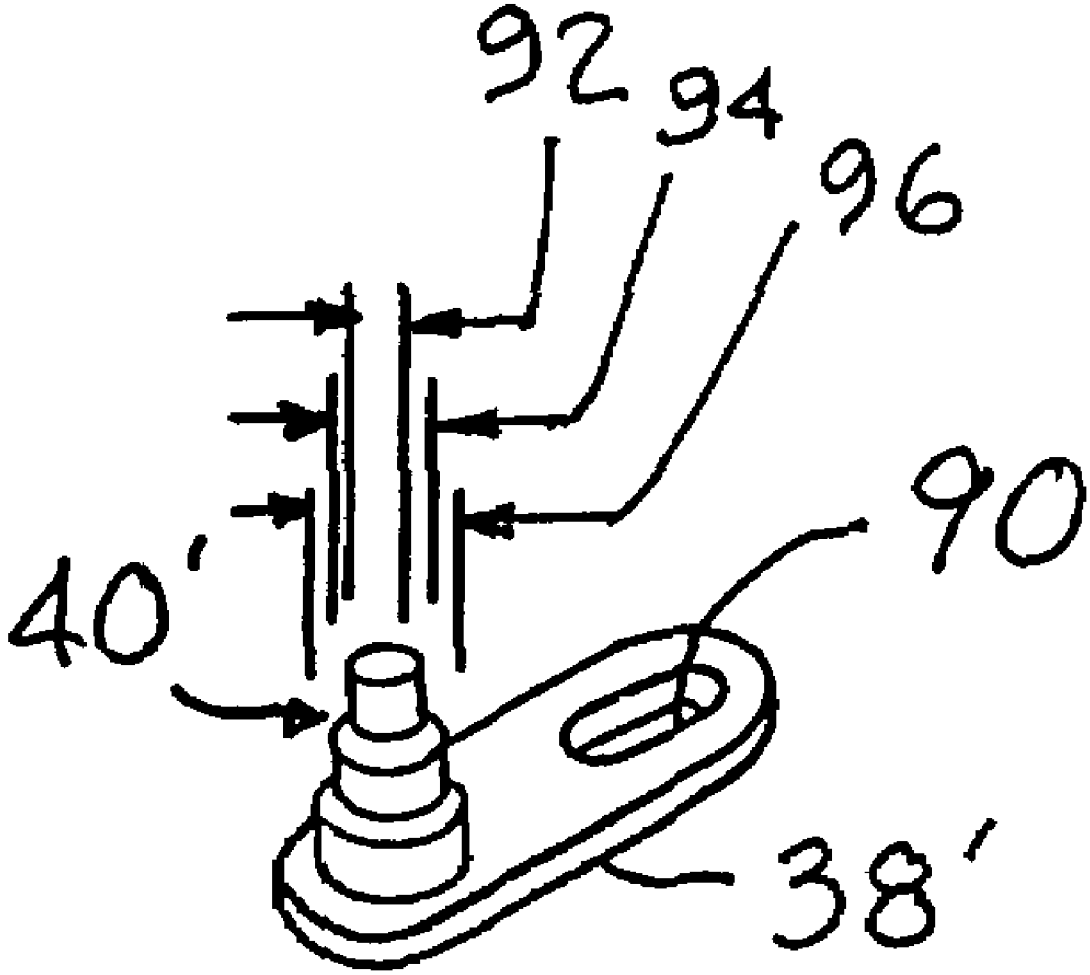
FIG. 14 is an alternative embodiment for the post and link useful in the practice of the present invention.

Referring now to FIG. 14, an alternative embodiment for the link 38' and post 40' may be seen. Link 38' has a slot 90 for aperture 44, instead of a circular hole, as illustrated in FIG. 1. Post 40' has a stepped configuration with a plurality of diameters 92, 94, 96 on which to form the loop 80. Although three diameters are shown, it is to be understood that more or fewer diameters may be used in the practice of the present invention. Furthermore, it is to be understood that the aperture shape and number of diameters for post 40 are independent of each other and may be utilized as such.

Figure 16:
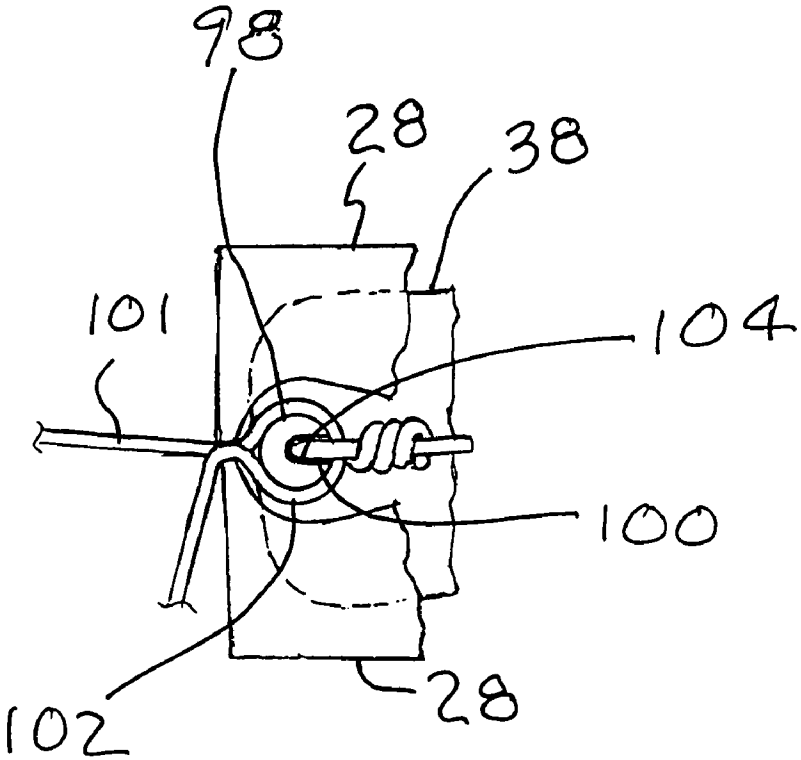
FIG. 16 is a top plan view of the parts shown in FIG. 15 in a second position.
Figure 15:
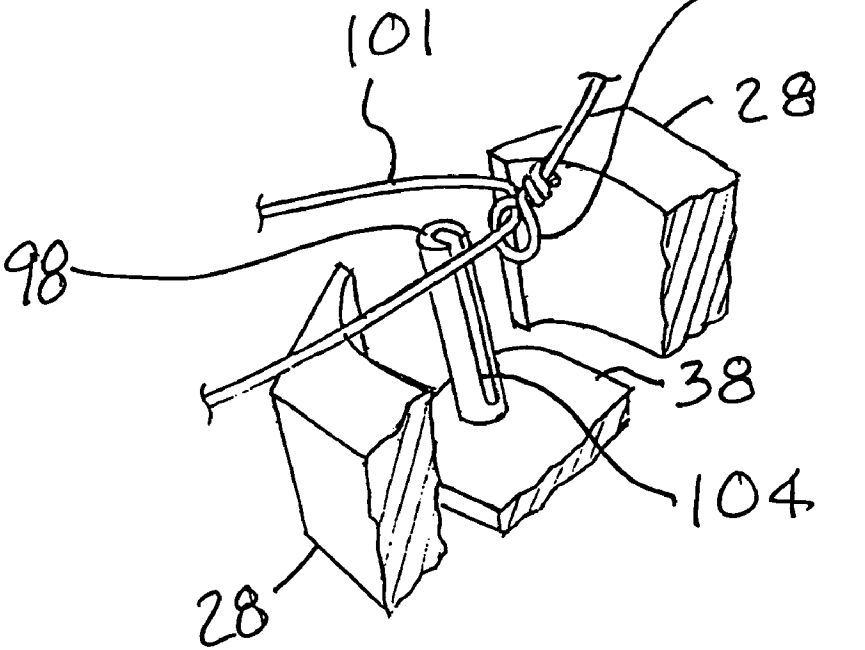
FIG. 15 is an enlarged fragmentary perspective view of the jaws with an alternative embodiment of the post and link in a first position for forming interengaging loops.

Referring now to FIGS. 15 and 16, a still further variation for post 40 may be seen. In this embodiment, a slotted post 98 may be used to form interengaging loops 100, 102. Loop 100 is formed in the same manner as loop 80, after which loop 100 is received over a U-shaped portion of wire 101, and the loop 100 is then received in a slot 104 in post 98 as loop 102 is formed in the same manner as loop 80 and 100. Slot 104 is sized to receive loop 100 and to permit formation of loop 102 without deformation caused by loop 100 being trapped between loop 102 and a cylindrical post.

In the practice of one embodiment of the present invention it is to be understood that it is preferable that link 38 be loosely secured to the mediate portion 30 of the first and second members 24 to permit limited movement of the post 40 within the recess 76 between the reliefs 74 of jaws 28. Referring now most particularly to FIG. 11, the jaws 28 preferably have a closing arc 106 and the limited movement of the post 40 is to be understood to be in a direction 108 generally perpendicular to the closing arc of the jaws 28. The post 40 is thus free to move towards and away form the connecting means 36 along the direction of arrow 108. The post 40 may also be free to move in other directions, as well, but the freedom of movement in the direction of arrow 108 will allow for formation of generally circular loops with various gauges of wire. It is to be understood, however, that, in another embodiment, the link may be repositionably secured to the mediate portion 30 of the first and second members, to initially retain the post to a desired position or location with respect to the jaws, to make it easier to use the pliers by holding the post still relative to the pliers until the U-shaped portion of the wire is placed over the post.

Referring now most particularly to FIGS. 18-21, various views of an alternative embodiment of the present invention may be seen. In this embodiment screw 132 has additional threads 150 to accommodate a spring 160. Also in this embodiment, link 38 has been replaced by a modified link 138. Link 138 has a post 140 (which may be grooved, as shown in FIGS. 15 and 16, and may conveniently utilize a conventional roll pin secured to link 183, for example by brazing). Link 138 has a first end 142 at or near which post 140 is attached. Link 183 also has a second end 146 at or near which an elongated aperture 144 is located. Elongated aperture 144 allows a greater range of motion along axis or arrow 108 (see FIGS. 11 and 20) than is possible with the aperture 44 in the first embodiment described above. In particular, aperture or slot 144 allows the link to be moved to a position wherein the post 140 is located within the recess 76 between the jaws 28, as in the first embodiment; however, aperture 144 also allows the post to be positioned to a location 170 exterior and distal of the jaws 28, as shown in FIG. 26, for a purpose to be described infra.

Referring now also to FIGS. 22-25, spring 160 may be formed as a generally trapezoidal shape from metal sheet stock having a mediate portion in a plane 161, with a pair of guide fingers 162 at a wide end 164, and a relatively flat tongue 166 at a narrow end 168 opposite the wide end 164. A clearance aperture 172 is located intermediate the ends 164 and 168 and is received over screw 132 in assembly and the locking nut 52 is preferably advanced sufficiently along threads 150 to gently urge link 138 against the mediate region 30 of the pliers, sufficient to hold the link 138 and post 140 fixed relationship to the pliers, but at the same time, the force exerted by spring 160 acting to urge link 138 against the mediate region 30 of the pliers is preferably low enough to allow manual repositioning of the post 140 by manually moving the link 138 or post 140 with respect to the mediate portion of the pliers. Repositionably retaining link 138 to a desired location with respect to the pliers is to be understood to be a convenience to the user to enable initial positioning of the post 140 with respect to the pliers 22. The force exerted by spring 160 is also to be understood to be low enough to be overcome by the side forces exerted on the wire as the jaws 28 close in forming a loop in the wire. Spring 160 has a curve 174 at the wide end 164 which positions the fingers 162 out of the plane 161 such that fingers 162 straddle link 138 in assembly, holding the spring 160 in longitudinal orientation to the link 138, regardless of the position of link 138 along axis 108, which passes through the centers of post 140 and pivot 36.

Figure 26:
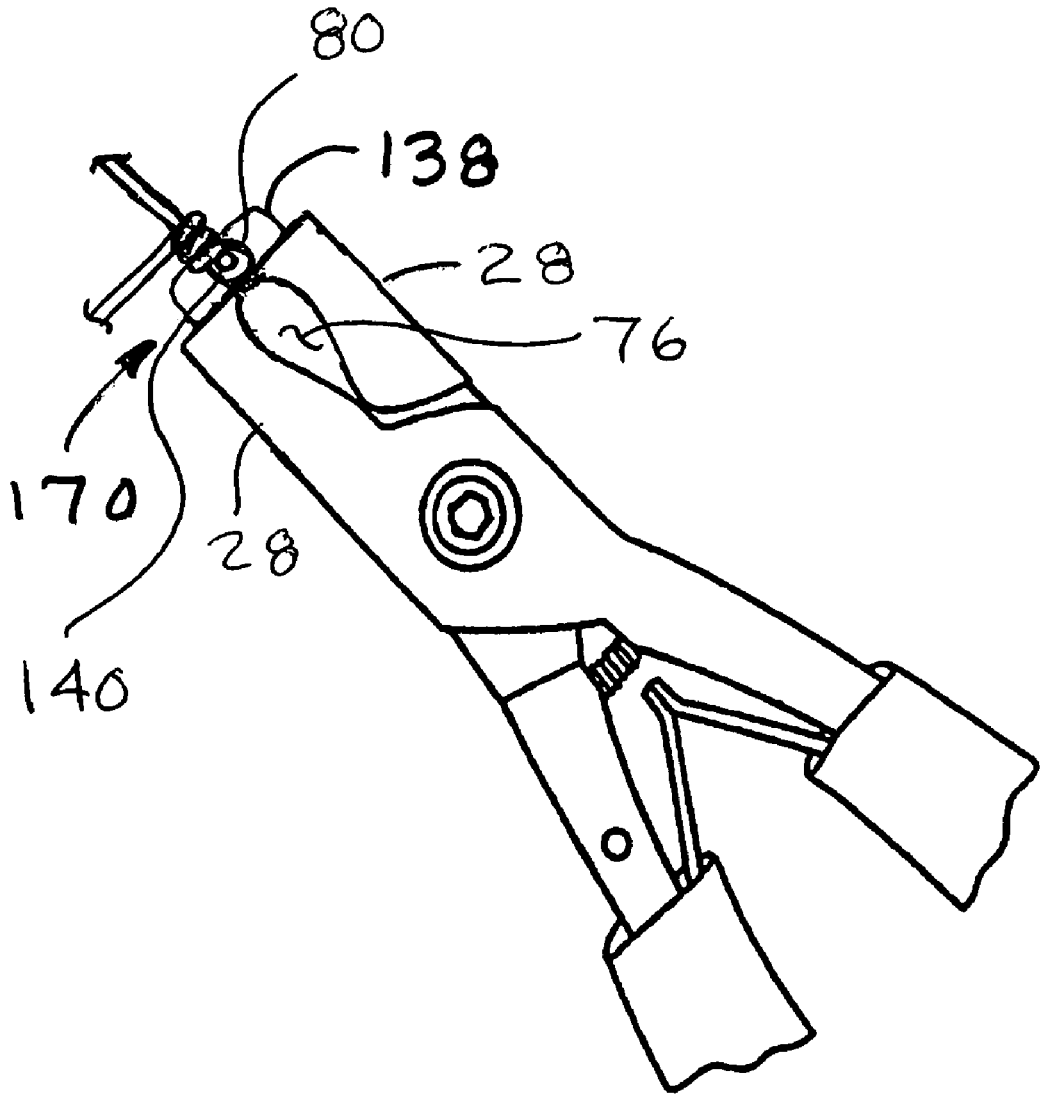
FIG. 26 is a view similar to that of FIG. 8, except showing the alternative embodiment of FIG. 18 with the link extended to an alternate position for the post and wire around the post beyond the jaws.

Referring now most particularly to FIG. 26, after a loop 80 is formed in the wire within the recess 76, the post 140 carrying loop 80 may be moved to a location or position 170 which is exterior and distal of the jaws 28 to enable tighter configurations of deformed portions (e.g., wraps) of the wire adjacent the loop 80 than are possible with the loop 80 in the recess 76 in the pliers 22 of the present invention. FIG. 28 shows a several wraps positioned closely or tightly against the loop 80, made possible by the elongated aperture 144 permitting movement of the post to location 170 while still retaining the link 138 to the pliers 22.

The basic method of the present invention includes forming a loop 80 in wire 70 by forming a U-shape in the wire, placing the U-shape between the pair of jaws 28 in the pliers 22 which are of the type having opposing faces 72 on respective distal ends of the pair of jaws, with each jaw having a relief 74 between the face 72 and the pivot point 36 of the pliers 22. The reliefs 74 together form a recess 76, such that the U-shape may extend around the post 40 located in the recess 76. The method further includes closing the jaws 28 against the wire 70 such that the faces 72 compress the U-shape into a loop 80 surrounding the post 40. Finally, the method may include removing the wire loop 80 from the pliers 22. A further feature of the method includes carrying the post 40 by the link 38 loosely secured to the pivot point 36 of the pliers 22. In one aspect, the method may be carried out with pliers 22 having one or both opposing faces 72 being flat.

In one variation, the method of the present invention may include adjusting the stop 58 to limit the distance the faces 72 can approach each other. In another variation, the method may include using the through hole 66 in the pliers 22 to form the U-shape in the wire 70.

In another aspect, the method of the present invention includes deforming at least one of two portions of the wire 70 extending distally of the faces 72, more particularly deforming at least one portion of the wire around the other portion of the wire to form one or more coils or wraps 84 adjacent the loop 80.

In another aspect, the method may include moving the post out from the recess to locate the post distal of the tips of the jaws, in order to allow greater access to the loop. More particularly, in this aspect of the present invention, a user may move the post out from the recess to locate the post distal of the tips of the jaws; and then deform at least one portion of the wire around the other portion of the wire to form a coil more tightly adjacent the loop than would otherwise be convenient with the loop remaining within the recess formed by the jaws.

In other words, the method of forming a loop in wire according to the present invention may include initially positioning the post carried on the link to a desired position within the recess formed by the pair of reliefs in the jaws of the pliers, placing the U-shaped portion of the wire between the pair of jaws in the pliers such that the U-shape extends around the post located in the recess, and closing the jaws against the wire such that the faces compress the U-shape into a loop surrounding the post.

Figure 18:
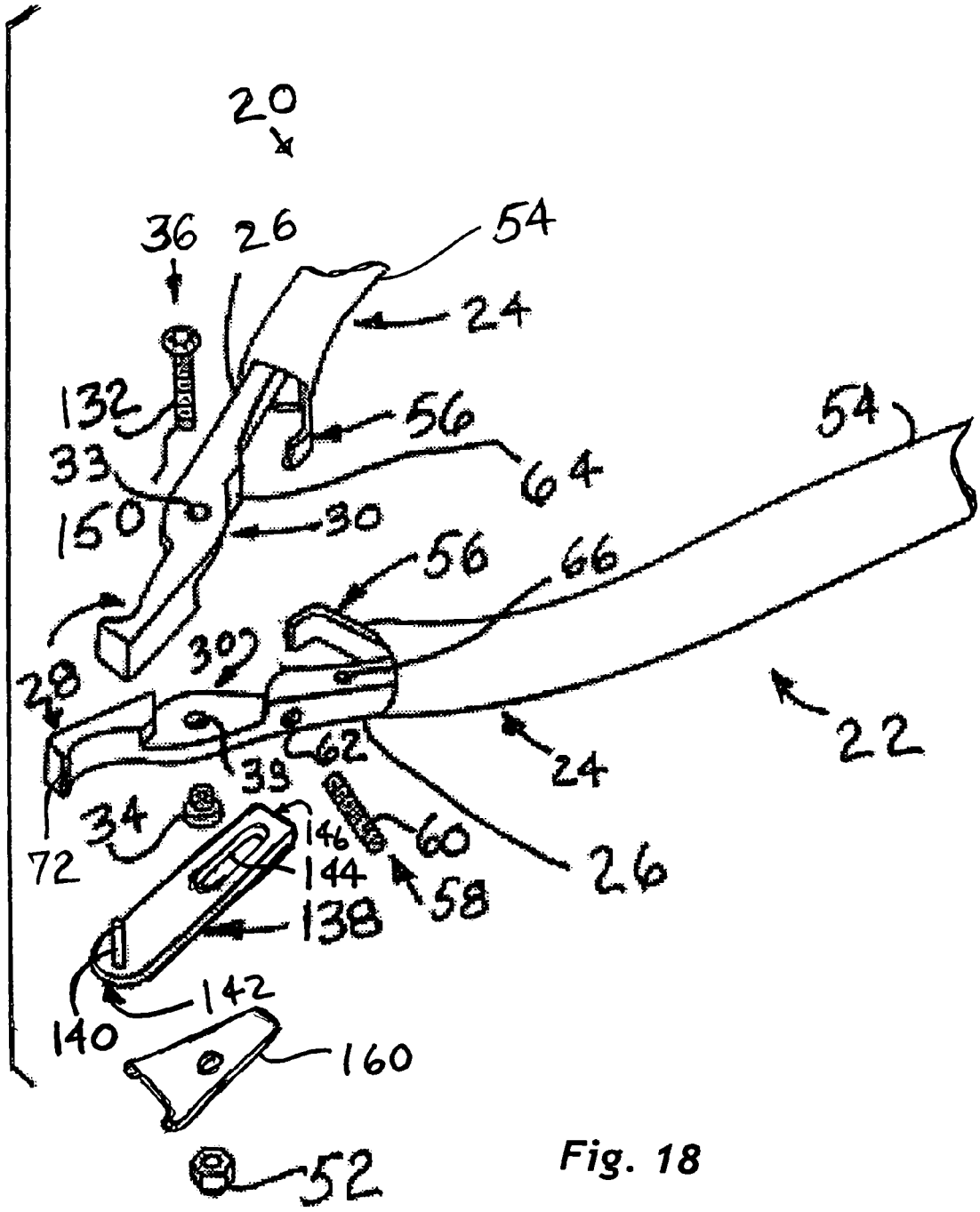
FIG. 18 is a perspective exploded view from above similar to that of FIG. 1, except showing parts for an alternative embodiment of the present invention.
Figure 19:
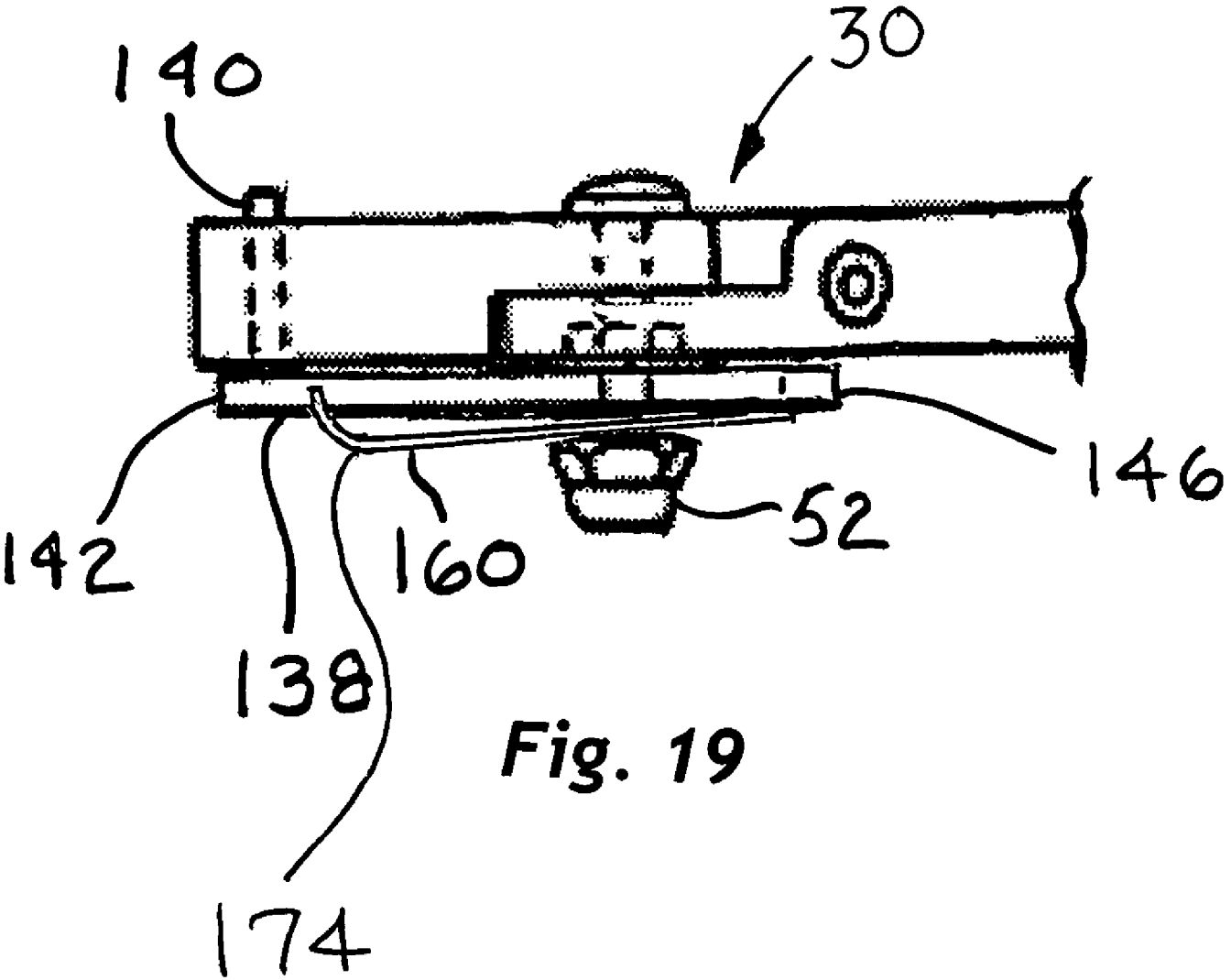
FIG. 19 is a fragmentary view similar to a portion of FIG. 2, except showing the alternative embodiment of FIG. 18.
Figure 20:
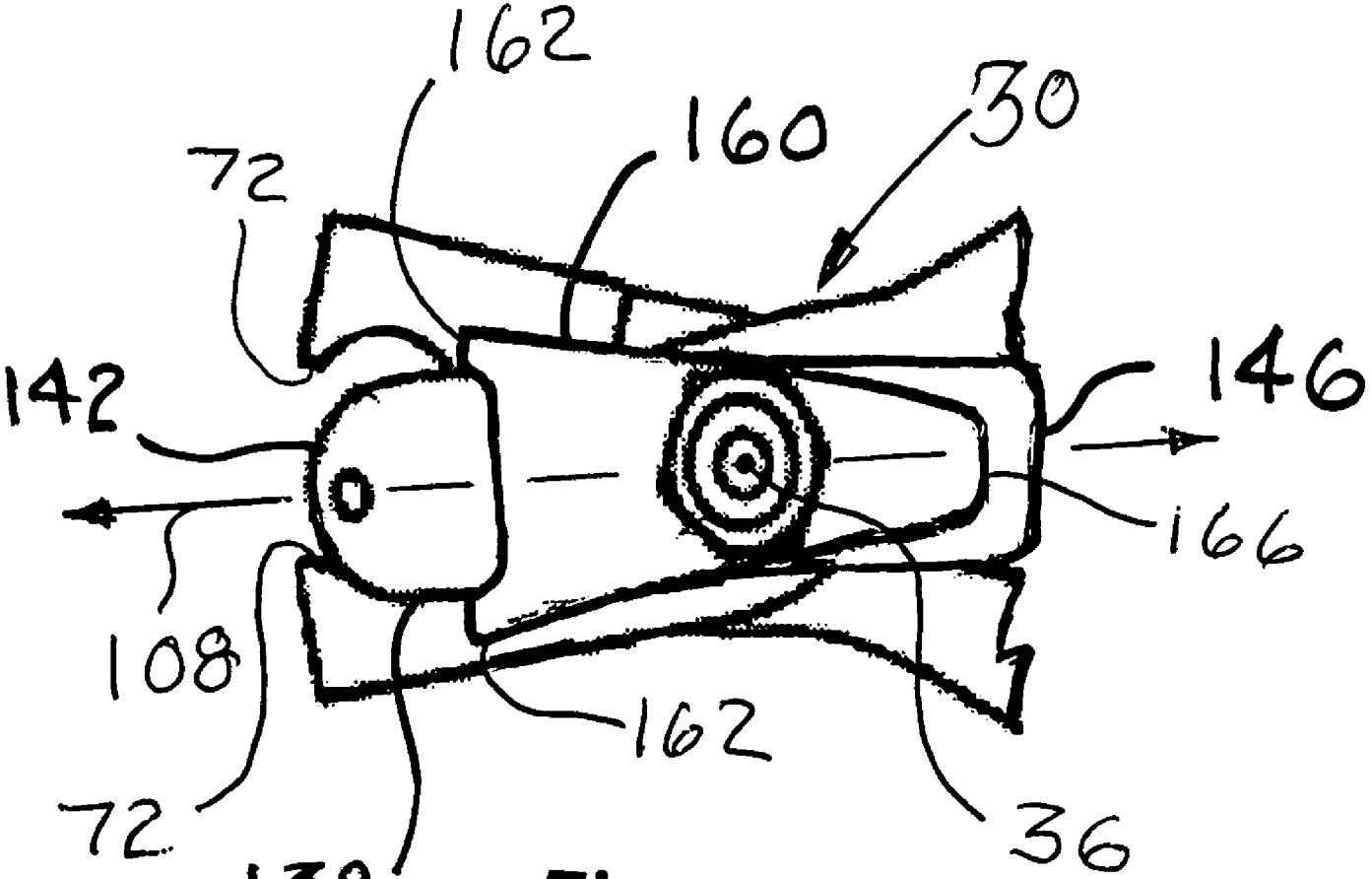
FIG. 20 is a fragmentary view similar to a portion of FIG. 3, except showing the alternative embodiment of FIG. 18.
Figure 21:
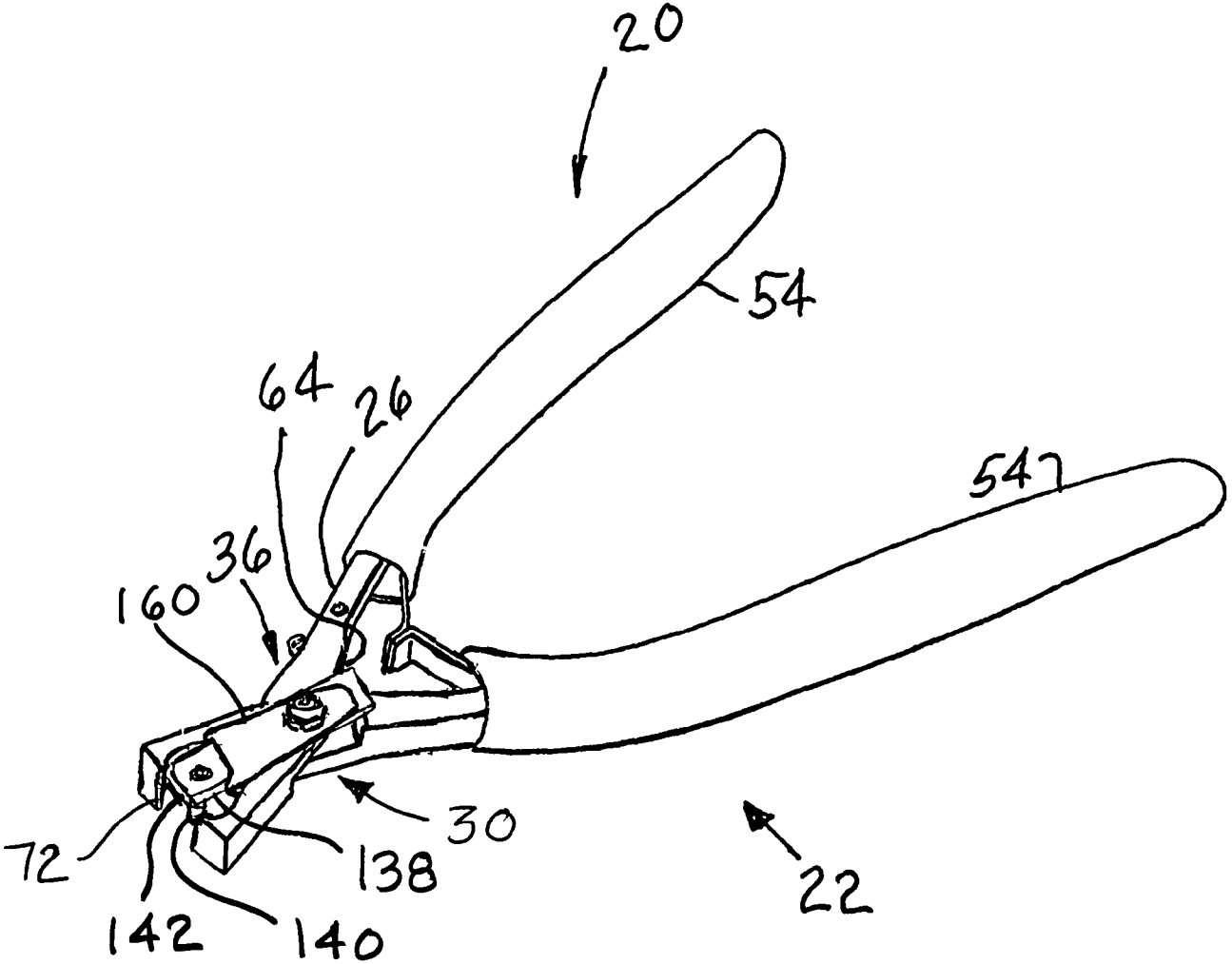
FIG. 21 is a perspective view similar to that of FIG. 4, except inverted, and showing various details of the alternative embodiment of FIG. 18.

In this aspect, the post and link are retained to and urged against the pivot point of the pliers to allow the post to be manually repositioned to a desired position or location and thereafter the pliers (in the alternative embodiment shown in FIG. 18 et seq. retain the post at the desired position, until the jaws close towards the post.

The link is urged against the pivot point of the pliers by a spring which allows manually repositioning of the post by moving the link to locate the post relative to the jaws of the pliers.

This invention is not to be taken as limited to all of the details thereof as modifications and variations thereof may be made without departing from the spirit or scope of the invention.

The invention claimed is:

1. A method of forming a loop in wire comprising;

a. forming a U-shape in a wire;

b. placing the U-shape between a pair of jaws in a pliers of the type having opposing faces on respective distal ends of a pair of jaws, with each jaw having a relief between the face and a pivot point having a pivot point axis about which the jaws of the pliers are free to rotate, the reliefs forming a recess, such that the U-shape extends around a post located in the recess; and c. closing the jaws against the wire such that the faces compress the U-shape into a loop surrounding the post wherein the post is constrained to have an axis that remains parallel to the pivot point axis while simultaneously remaining free to move both radially towards and away from the pivot point to permit formation of generally circular loops with various gauges of wire wherein the post is carried by a link retained to the pivot point of the pliers and urged against the pivot point by a spring to allow the post to be manually repositioned to a desired position and to initially retain the post at the desired position.

2. The method of claim 1 wherein the opposing faces are each flat.

3. The method of claim 1 further comprising an additional step before step c comprising:

c. adjusting a stop to limit the distance the faces can approach each other.

4. The method of claim 1 wherein step a further comprises using a through hole in the pliers to form the U-shape in the wire.

5. The method of claim 1 further comprising an additional step after step c comprising:

d. deforming at least one of two portions of the wire extending distally of the faces.

6. The method of claim 5 wherein step d further comprises deforming the at least one portion of the wire around the other portion of the wire to form a coil adjacent the loop.

7. The method of claim 1 further comprising an additional step after step c comprising:

d. moving the post out from the recess to locate the post distal of the tips of the jaws.

8. The method of claim 1 further comprising additional steps after step c, the additional steps comprising:

d. moving the post out from the recess to locate the post distal of the tips of the jaws; and e. deforming the at least one portion of the wire around the other portion of the wire to form a coil adjacent the loop.

9. A method of forming a loop in wire comprising;

a. positioning a post carried on a link to a desired position within a recess formed by a pair of reliefs in a pair of jaws of a pliers wherein the jaws of the pliers are free to rotate about an axis with respect to each other and wherein each jaw has a face, the faces opposing each other as the jaws close;

b. placing a U-shaped portion of a wire between the pair of jaws in the pliers such that the U-shape extends around a post located in the recess; and c. closing the jaws against the wire such that the faces compress the U-shape into a loop surrounding the post wherein the post is constrained to remain parallel to the axis of the jaws while simultaneously remaining free to move both radially towards and away from the axis of the jaws without disassembly, wherein the post is carried by a link retained to the pivot point of the pliers and urged against the pivot point by a spring which allows the post to be manually repositioned to a desired position and to initially retain the post at the desired position.

10. The method of claim 6 further comprising the additional step between steps c and d of c1. moving the post out from the recess to locate the post distal of the tips of the jaws and reclosing the jaws with the post distal of the tips of the jaws.

* * * * *